US006472818B1

(12) United States Patent
Ikeda et al.

(10) Patent No.: US 6,472,818 B1
(45) Date of Patent: Oct. 29, 2002

(54) LIGHT BULB

(75) Inventors: Taku Ikeda, Katano; Kazuo Maeda, Takatsuki, both of (JP)

(73) Assignee: Matsushita Electronics Corporation (JP)

( * ) Notice: Subject to any disclaimer, the term of this patent is extended or adjusted under 35 U.S.C. 154(b) by 96 days.

(21) Appl. No.: 09/615,735

(22) Filed: Jul. 13, 2000

(30) Foreign Application Priority Data

Jul. 28, 1999 (JP) ..... 11-213294
Apr. 26, 2000 (JP) ..... 2000-125759

(51) Int. Cl.[7] ..... H01K 1/54

(52) U.S. Cl. ..... 313/558; 313/557; 313/559; 313/560

(58) Field of Search ..... 313/553, 557, 313/558, 559, 560, 561

(56) References Cited

U.S. PATENT DOCUMENTS 4,380,714 A * 4/1983 Bouman et al. ..... 313/559 X
4,415,833 A * 11/1983 Oetken et al. ..... 313/559

FOREIGN PATENT DOCUMENTS

| | | |
|---|---|---|
| JP | 57-1862 | 1/1982 |
| JP | 8-129994 | 5/1996 |
| JP | 8-329905 | 12/1996 |

* cited by examiner

*Primary Examiner*—Ashok Patel
(74) *Attorney, Agent, or Firm*—Parkhurst & Wendel, LLP

(57) ABSTRACT

Providing a light bulb having a long life by preventing filament coil breakage. A glass bulb (1) has a sealing portion (4) at one end thereof and contains a filament coil (5). The filament coil (5) is suspended between lead-in wires (7, 8) extended externally of the sealing portion (4), with its opposite ends connected to respective one ends of the wires. The lead-in wires (7, 8) are supported by a stem (6) disposed between the sealing portion (4) and the filament coil (5). A getter (9) is disposed between the sealing portion (4) and the stem (6).

10 Claims, 4 Drawing Sheets

LIGHT BULB

FIELD OF THE INVENTION

The present invention relates to light bulbs generally used in stores, exhibition halls and the like.

BACKGROUND OF THE INVENTION

The conventional light bulbs, such as halogen bulbs, generally contain therein a getter for suppressing a water cycle effect which is responsible for shortened service life of the bulbs (see Japanese Examined Patent Publication No.57-1862 (1982) and Japanese Unexamined Patent Publication nods.8-129994 and 8-1299905(1996)).

As shown in FIG. 6, a light bulb disclosed in Japanese Unexamined Patent Publication No.8-129994, for example, includes a quartz glass envelope 18 which is formed with a sealing portion 17 at one end thereof and contains therein a pair of lead-in wires 19, 20 extended externally of the sealing portion 17, a tungsten filament 21 suspended between the lead-in wires 19, 20 along an envelope axis, and a quartz glass stem 22 interposed between the filament 21 and the sealing portion 17 and supporting the pair of lead-in wires 19, 20.

The quartz glass envelope 18 is filled with predetermined amounts of a gas mixture of argon and nitrogen and of hydrogen bromide.

A tantalum getter 23 is supported at a place closer to the filament 21 than to the quartz glass stem 22, or at an upper part of the lead-in wire 20.

Since a conventional halogen bulb like this has the tantalum getter 23 disposed closer to the filament 21 than to the quartz glass stem 22, tantalum oxides liberated from the tantalum getter 23 reduced in mechanical strength due to its reaction with oxygen are carried to the vicinity of the filament 21 by convection currents occurring within the quartz glass envelope 18. Subsequently, the liberated tantalum oxides floating near the filament 21 are thermally decomposed so that tantalum is deposited on the filament surface 21 to form thereon an alloy of tantalum and tungsten (hereinafter, simply referred to as alloy). Since this alloy has a melting point (2,850° C.) lower than that (3,400° C.) of tungsten, a lower melting point portion is formed on a part of the filament 21. The lower melting point portion evaporates excessively to cause the filament 21 to break. Thus, the bulb life is shortened.

The invention contemplates a solution to this problem and has an object to provide a light bulb which can prevent a filament coil from breaking, thereby securing extended bulb life.

DISCLOSURE OF THE INVENTION

A halogen bulb according to the invention comprises a glass bulb having a sealing portion at one end thereof and containing a pair of lead-in wires extended externally of the sealing portion, a filament coil suspended between the lead-in wires, and a stem interposed between the filament coil and the sealing portion and supporting the lead-in wires, wherein a getter is located in an exposed manner between the sealing portion and the stem.

In this arrangement, the stem hinders convection currents occurring around the filament coil from carrying tantalum oxides liberated from the getter to and around the filament coil. Accordingly, an alloy of tantalum forming the getter and tungsten forming the filament coil can be prevented from forming on the surface of the filament coil and hence, the filament coil can be prevented from breaking. As a result, a light bulb having an extended service life can be provided.

PREFERRED EMBODIMENTS OF THE INVENTION

Preferred embodiments of the invention will hereinbelow be described with reference to the accompanying drawings.

Figure 1:
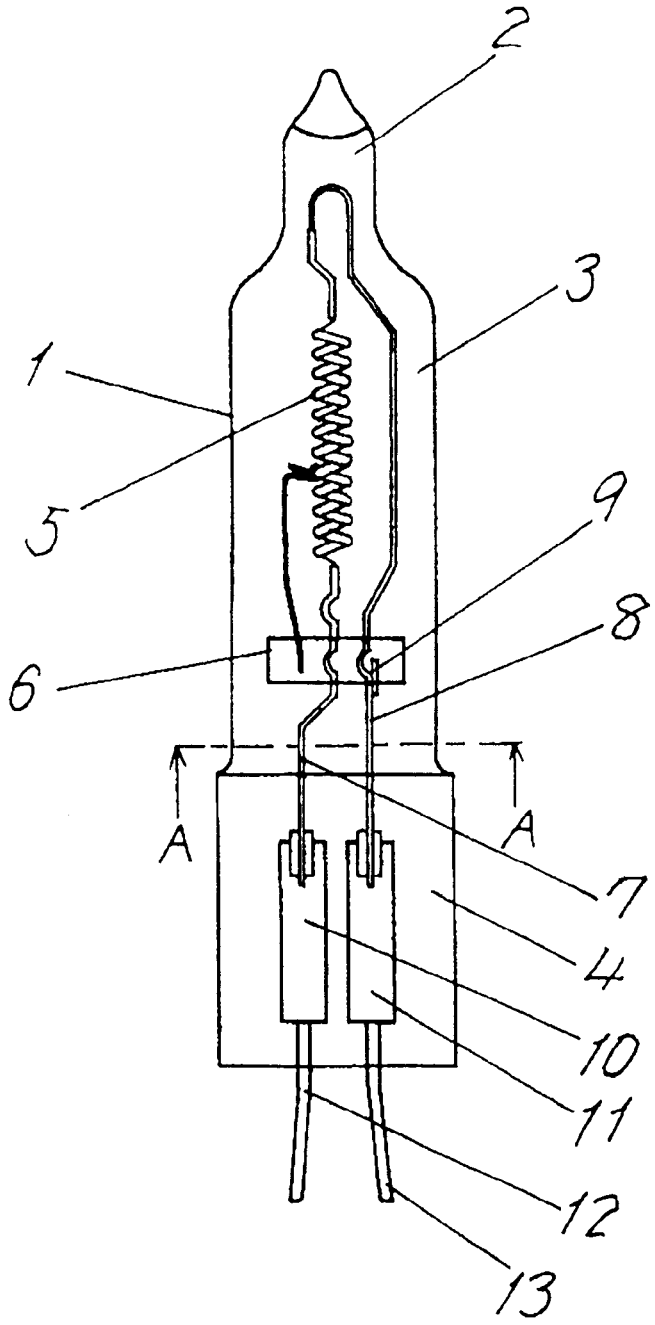
FIG. 1 is a front view showing a halogen bulb according to a first embodiment of the invention.

As shown in FIG. 1, a 130-watt halogen bulb according to a first embodiment of the invention has a quartz glass bulb 1 having an overall length of 55 mm.

The glass bulb 1 is comprised of a closed-end portion 2, a hollow tube 3 and a sealing portion 4 which are formed in a continuous fashion. The glass bulb I is filled with an inert gas and a trace of a gas mixture of organic halogen compounds at 0.2 MPa.

The hollow tube 3 is of a cylindrical shape having an outside diameter of 11 mm. A tungsten filament coil 5 is disposed along a center axis within the hollow tube 3. Opposite ends of the filament coil 5 are connected to respective one ends of a pair of lead-in wires 7, 8 extended externally of the sealing portion 4.

The lead-in wires 7, 8 are spaced apart from each other and supported by a quartz glass stem 6 interposed between the sealing portion 4 and the filament coil 5. The stem is also provided with a tantalum bar-shaped getter 9 having a diameter of 0.20 mm and an overall length of 2 mm. The getter is partially exposed in a space between the sealing portion 4 and the stem 6, as will be described hereinlater. Respective the other ends of the lead-in wires 7, 8 are connected to lead-out wires 12, 13 via molybdenum metal foil pieces 10, 11 sealed in the sealing portion 4.

Figure 2:
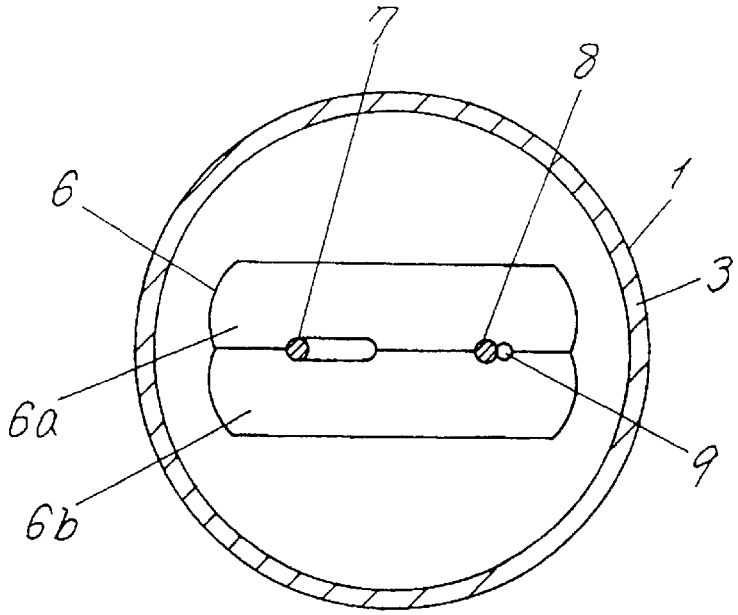
FIG. 2 is a sectional view taken on the line A—A in FIG. 1.

As shown in FIG. 2, the stem 6 is formed of two column-like solid bars 6*a*, 6*b* each having an outside diameter of 2.5 mm and an overall length of 7 mm. Side surfaces of the solid bars 61, 6*b* are partially fusion bonded with each other. The lead-in wires 7, 8 are clamped between the bonded surfaces of the solid bars 6*a*, 6*b*. The getter 9 is also partially clamped between the bonded surfaces of the solid bars 6*a*, 6*b* to be retained by the stem 6. That is, the getter 9 is arranged such that its main axis is located in parallel to the lead-in wires 7, 8 but not in a plane between the lead-in wires 7, 8.

The material for the getter 9 is not limited to tantalum but may be any alloy containing tantalum and at least one selected from a group consisting of niobium and zirconium.

Next, advantages of such a halogen bulb (hereinafter referred to as inventive product) will be described.

Life characteristics of the inventive product and a conventional product to be described later were comparatively examined in the following manner.

First, there were prepared twenty inventive products and twenty halogen bulbs (hereinafter referred to as conventional product) having the same construction as that of the inventive product except that the getter of a tantalum foil piece was soldered to a portion of the lead-in wire near a connection with a filament coil end located farther from the stem. Subsequently, the respective products were burned at a rated voltage of 110 V to determine the life characteristics of the respective products. The results are shown below in Table 1.

A period of time from lighting up of a halogen bulb to breaking of the filament coil is defined as life of a lamp. A mean life was determined based on Weibull mean life. The shortest life is a life span of a lamp which was the fastest to suffer a filament breakage.

The above mentioned also applies to the test results shown in Tables 2 and 3.

TABLE 1

| | Weibull mean life | Shortest life |
|---|---|---|
| Inventive product | 3,120 hrs | 2,700 hrs |
| Conventional product | 2,200 hrs | 1,470 hrs |

As apparent from Table 1, the inventive product presented the Weibull mean life of 3,120 hours and the shortest life of 2,700 hours, whereas the conventional products presented the Weibull mean life of 2,200 hours and the shortest life of 1,470 hours.

Thus, the inventive product improved the Weibull mean life by 42% and the shortest life by 84% over the conventional product.

In the conventional products, deposition was visually observed on the surfaces of the filament coils after a lapse of 1,000 hours of burning.

Then, out of the conventional products, those having a life of less than 2,200 hours were further examined using a scanning electron microscopy to observe the surfaces of the filament coils at and around the broken portions thereof. The microscopic images revealed that tantalum crystals were deposited on the surfaces of the filament coils at and around the broken portions thereof. Qualitative analysis of the broken portions of the filaments coils indicated that a 3 $\mu$m thick layer of an alloy of tantalum and tungsten was formed on the tungsten surface.

In contrast, no deposition of tantalum crystals was observed on the surfaces of the filament coils of the inventive products. It is believed that the stem 6 prevents tantalum oxides liberated from the weakened getter 9 from joining in convection currents around the filament coil 5, thereby suppressing the formation of suspension of liberated tantalum oxides in the vicinity of the filament coil 5. Thus, the inventive product can prevent the alloy of tantalum and tungsten from being deposited on the filament coil surface 5.

As described above, the getter 9 partially exposed in the space between the sealing portion 4 and the stem 6 is effective to prevent the filament coil 5 from breaking, allowing the bulb life to be extended.

The arrangement of the getter 9 partially retained by the stem 6 provides easy mounting of the getter 9 in the glass bulb 1, facilitating the production process.

Because of the bar-like shape of the getter 9, it is easy for the stem 6 to retain the getter 9. Such a shape of the getter provides sufficient contact area between the getter 9 and the stem 6 so that the getter 9 is less liable to drop off. Further, a getter may also be in the form of a plate or a foil to be readily retained by the stem 6. In addition, the getter in the form of a plate or a foil provide a greater contact area than the bar-like getter 9 does. As a result, the plate-like or foil-like getter is even less liable to drop off the stem 6.

The following problem is encountered by the bar-like getter 9. When reduced in mechanical strength due to the reaction with oxygen, the getter 9 is gradually reduced in thickness because it evaporates while the light bulb is burning, and the getter 9 is finally broken. As a result, the getter 9 is unable to maintain its function as a getter any longer.

In this regard, examination was conducted on the diameter of getters 9 capable of maintaining the function as a getter for more than the rated life of 3,000 hours. The diameter of the getter 9 was varied on the basis of 0.01 mm because it is difficult to adjust the diameter to the precision of less than 0.01 mm in the production process.

Halogen bulbs according to the invention were produced, which were varied in the diameter of the getter 9. Life characteristics of each lamps thus produced were examined. The results are shown below in Table 2.

TABLE 2

| | Diameter of Getter (mm) | | | | |
|---|---|---|---|---|---|
| | 0.10 | 0.15 | 0.19 | 0.20 | 0.25 |
| Weibull Mean Life | 2,040 hrs | 2,350 hrs | 2,870 hrs | 3,120 hrs | 3,220 hrs |

As is apparent from Table 2, when the getter 9 is not less than 0.20 mm in diameter, the Weibull mean life can exceed the rated life. On the other hand, the bulbs with the getter 9 not more than 0.19 mm in diameter have the Weibull mean life below the rated life.

A getter with a diameter in excess of 0.40 mm is liable to drop off the stem 6 and hence is not practicable.

As mentioned supra, the bar-like getter 9 formed to have a diameter of between 0.20 and 0.40 mm secures such a thickness that the getter does not break even after a lapse of the rated life in the state where the getter is reduced in mechanical strength by the reaction thereof with oxygen. Thus, the gettering function can be maintained.

It is preferred that the getter 9 is retained by the stem 6 and not located in a plane between the lead-in wires 7, 8. The reason for this will be described hereinlater with reference to results of comparative examination on the life characteristics between the inventive products and comparative products.

There were prepared twenty inventive products and twenty halogen bulbs (hereinafter referred to as comparative product) having the same construction as that of the inventive product except that the getter retained by the stem 6 was located in a plane between the lead-in wires 7, 8. The respective products were burned at a rated voltage of 110 V to determine the life characteristics of the respective products. The results are shown in Table 3 below.

TABLE 3

| | Weibull Mean Life | Shortest Life |
|---|---|---|
| Inventive product | 3,120 hrs | 2,700 hrs |
| Comparative Product | 1,260 hrs | 560 hrs |

As apparent from Table 3, the inventive products presented the same results as those shown in Table 1, that is, the Weibull mean life was 3120 hours and the shortest life span was 2700 hours. On the other hand, the comparative products presented that the Weibull mean life was 1260 hours and the shortest life span was 560 hours.

Thus, the inventive products improved the Weibull mean life by 2.5 times and the shortest life span by 4.8 times.

The following reason may be given as to the inferior performances of the comparative products.

In the comparative products, tantalum oxides liberated from the weakened getter are adhered to a surface of the stem 6 opposing the sealing portion. Together with the lapse of burning time, the tantalum oxides are adhered to a greater area and eventually come into contact with each lead-in wire. As a result, the lead-in wires are electrically interconnected via the adhered tantalum oxides, short-circuited to produce electrical arc, and then broken.

In the inventive products, on the other hand, even if the tantalum oxides liberated from the weakened getter are adhered to the surface of the stem 6 opposing the sealing portion 4, the lead-in wires 7, 8 do not electrically interconnect because the getter 9 is sufficiently spaced apart from at least one of the lead-in wires 7, 8. Hence, no breakage occurs in the lead-in wires 7, 8.

Accordingly, the bulb life is further extended by virtue of the getter 9 retained by the stem 6 and not located in a plane between the lead-in wires 7, 8.

It is more preferred that the getter 9 is arranged such that its main axis is located in parallel to the lead-in wires 7, 8 but not in a plane between the lead-in wires 7, 8, as in the inventive product. This arrangement accomplishes further, extension of the bulb life.

The reason is that the lead-in wire 8 prevents the adhered tantalum oxides from growing toward the lead-in wire 7.

Figure 3:
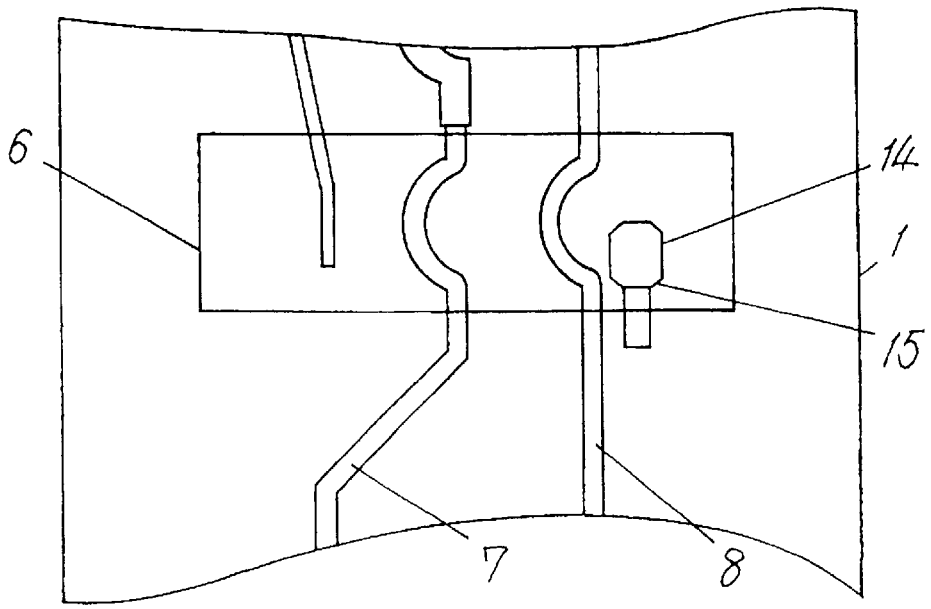
FIG. 3 is an enlarged front view showing a principal part of a halogen bulb according to a second embodiment of the invention.
Figure 4:
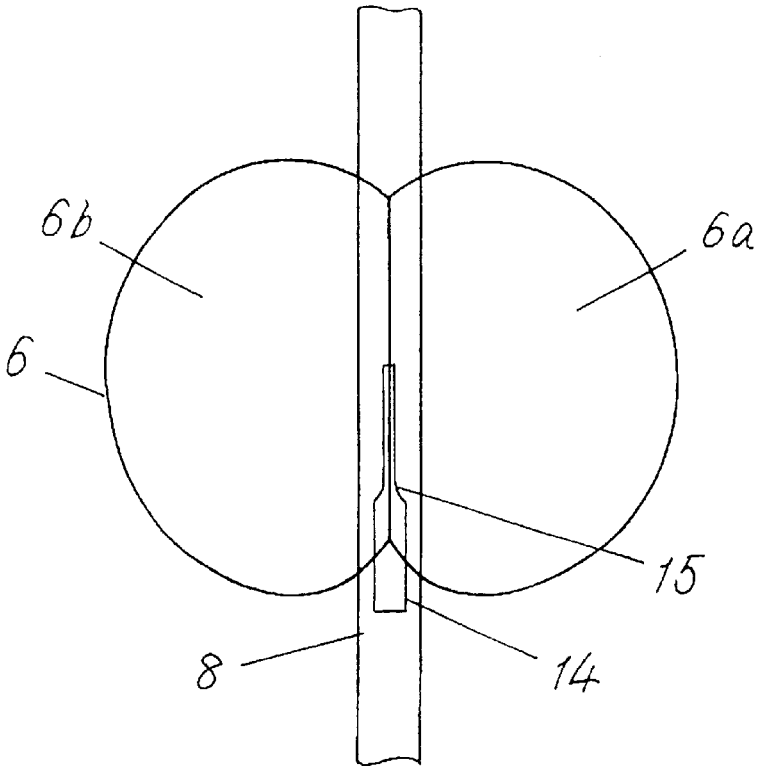
FIG. 4 is an enlarged side view showing the principal part of the bulb.

Next, as shown in FIGS. 3, 4, a 130-watt halogen bulb according to a second embodiment is constructed the same way as the 130-watt halogen bulb of the first embodiment except that a getter 14 includes a plate-like portion formed by pressing an end of a tantalum bar of 0.2 mm in diameter and 2 mm in total length into a plate-like shape having a thickness of 0.1 mm and a maximum width of 0.3 mm.

The getter 14 has a plate-like portion including a shoulder 15 defined between the plate-like portion and the bar portion. The getter 14 is retained by the stem 6 in a manner that the plate-like portion inclusive of the shoulder 15 is entirely clamped between joint faces of solid bars 6*a*, 6*b* of the stem 6. The bar portion of the getter 14 is exposed in a space between the sealing portion 4 (not shown in FIGS. 3 and 4) and the stem 6. In addition, the getter 14 is arranged such that its main axis is located in parallel to the lead-in wires 7, 8 but not in a plane between the lead-in wires.

With the halogen bulb according to the second embodiment, the extended bulb life is achieved because the filament coil 5 can be prevented from breaking. In addition, the getter 14 includes the plate-like portion formed by pressing one end of the bar into a plate shape, and the shoulder 15 defined between the bar portion and the plate-like portion, which shoulder 15 is held (clamped) by the stem 6 such that the shoulder 15 is caught by the stem 6, particularly to the effect that the getter 14 is even less liable to drop off the stem 6.

According to the description of the second embodiment, the getter 14 is formed with the shoulder 15 in order for more securely preventing the getter 14 from dropping off the stem 6. Alternatively, for example, the getter 14 may be formed with a bent portion formed by bending a bar-like getter body or with a projection on an outer periphery of the bar-like getter body such that the bent portion or projection may be retained by the stem 6. Such arrangements are also effective to more securely prevent the getter from dropping off the stem 6.

Figure 5:
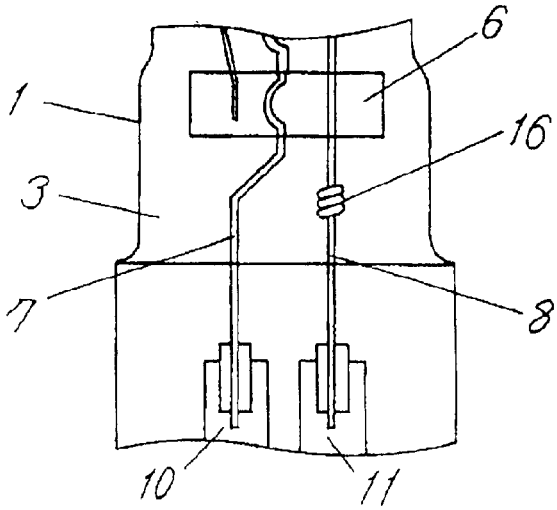
FIG. 5 is an enlarged front view showing a principal part of a halogen bulb according to a third embodiment of the invention.
Figure 6:
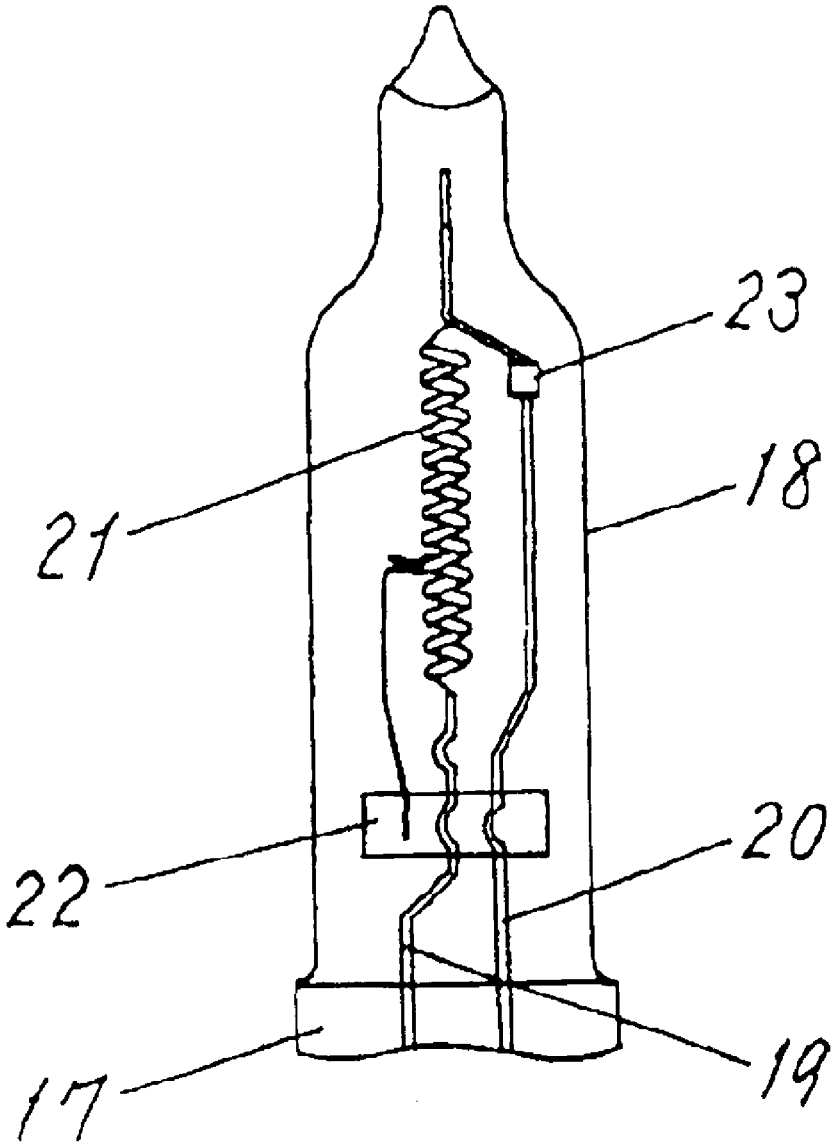
FIG. 6 PRIOR ART
FIG. 6 is a front view showing a principal part of a conventional halogen bulb.

As shown in FIG. 5, a 130-watt halogen bulb according to a third embodiment of the invention is constructed the same way as the 130-watt halogen bulb of the first embodiment except that a coiled tantalum getter 16 (0.2 mm in thickness) is fixed to the lead-in wire 8.

The coiled getter 16 is tightly wound about the lead-in wire 8, thereby being firmly fixed thereto.

According to the above arrangement, the getter 16 is spaced apart from the stem 6 so that tantalum oxides can be prevented form adhering to the stem surface 6. This ensures prevention of the short circuit between the lead-in wires 7, 8 more reliably, so that the bulb life can be further extended. Even when the getter 16 becomes too weakened to be fixed onto the lead-in wire 8, the getter 16 can be prevented from dropping off the lead-in wire 8, allowing the gettering function to be maintained.

Although the second embodiment has been described for the halogen bulb including the coiled getter 16, a pipe-shaped getter may also contribute to attain similar effects to the above. It should be noted that in case the pipe-shaped getter is used, the getter is threaded through the lead-in wire 8, and then caulked to be fixed onto the lead-in wire 8.

Although the foregoing description of the embodiments of the invention has been made for the cases using a glass bulb 1 of quartz glass, similar effects may be attained by using a bulb formed of a hard glass or the like.

Although the foregoing description of the embodiments of the invention has been made for the cases using a glass bulb 1 having a cylindrical hollow tube portion 3, similar effects to the above may be attained by using a bulb having a corresponding portion to the hollow tube portion 3 as formed in a spheroidal or generally spherical shape.

In the foregoing embodiments, the glass bulb 1 may have a surface coated with an infrared reflection film.

With a lighting equipment in which the inventive halogen bulb and a reflector are integrally formed, the similar effects to the above may also be attained.

Although the foregoing description of the embodiments has been made for the cases using halogen bulbs, krypton bulbs or incandescent bulbs may be used for attaining the similar effects to the above.

What is claimed is:

1. A light bulb comprising:

a sealing portion at one end thereof and containing a pair of lead-in wires extending externally of said sealing portion, a filament coil-suspended between the pair of lead-in wires, and a stem interposed between the filament coil and the sealing portion and supporting the pair of lead-in wires, wherein a getter is between the sealing portion and the stem and is not in a plane defined by the pair of lead-in wires.

2. The light bulb as set forth in claim 1, wherein a part of the getter is retained by the stem.

3. The light bulb as set forth in claim 1, wherein the getter has a main axis located parallel to the pair of lead-in wires.

4. The light bulb as set forth in claim 1, wherein the getter has a bar-like shape.

5. The light bulb as set forth in claim 4, wherein the getter has a diameter of not less than 0.20 mm and not more than 0.40 mm.

6. The light bulb as set forth in claim 1, wherein the getter is shaped like a plate or a foil.

7. The light bulb as set forth in claim 4, wherein the bar-like getter includes one end thereof in a plate-like shape.

8. The light bulb as set forth in claim 1, wherein the getter includes at least one of a shoulder, a bent portion and a projection at a portion thereof retained by the stem.

9. The light bulb as set forth in claim 1, wherein the getter is shaped like a coil or a pipe and securely fitted onto at least one of the lead-in wires.

10. The light bulb as set forth in claim 1, wherein the getter comprises a material selected from the group consisting of tantalum and alloys thereof.

* * * * *